United States Patent [19]

Moyer

[11] Patent Number: 4,646,878

[45] Date of Patent: Mar. 3, 1987

[54] PORTABLE LADDER STEP

[76] Inventor: Robert Moyer, Box 63, Flat Rock, Ohio 44828

[21] Appl. No.: 879,268

[22] Filed: Jun. 27, 1986

[51] Int. Cl.[4] ..... E06C 7/16

[52] U.S. Cl. ..... 182/121; 248/238

[58] Field of Search ..... 182/121, 122, 120, 187; 248/238

[56] References Cited

U.S. PATENT DOCUMENTS

| | | | |
|---|---|---|---|
| 248,014 | 10/1881 | Boardman . | |
| 812,620 | 2/1906 | Van Alstine . | |
| 1,084.034 | 1/1914 | Roberts . | |
| 1,187,437 | 6/1916 | Lucas | 182/121 |
| 1,216,214 | 2/1917 | Connell . | |
| 1,462,086 | 7/1923 | Echlin | 182/121 |
| 1,820,315 | 8/1931 | Miller . | |
| 1,943,626 | 1/1934 | Richard | 182/121 |
| 2,151,135 | 3/1939 | Moberg | 182/121 |
| 2,237,596 | 4/1941 | Eilers | 182/121 |
| 2,297,883 | 10/1942 | Glover . | |
| 2,432,206 | 12/1947 | Mott . | |
| 2,439,185 | 4/1948 | Patt . | |
| 2,459,437 | 1/1949 | Kreissler et al. . | |
| 2,486,783 | 11/1949 | Hartman et al. . | |
| 2,665,952 | 1/1954 | Edwards . | |
| 3,899,045 | 8/1975 | Geisel | 182/121 |
| 4,425,985 | 1/1984 | Geisel | 182/121 |

*Primary Examiner*—Reinaldo P. Machado
*Attorney, Agent, or Firm*—Peter D. Keefe

[57] ABSTRACT

A portable ladder platform having locking and leveling features. A platform is provided which attaches to a standard rung type ladder through brace members, one of which is hook shaped for placement over a rung, and another, which is pivotable, moves under the rung to prevent accidental dislodgement of the platform in use. A leveling device is provided which allows adjustment for varying ladder angles.

7 Claims, 5 Drawing Figures

PORTABLE LADDER STEP

BACKGROUND OF THE INVENTION

This invention relates to ladder platforms, more particularly to ladder platforms which are adjustable, portable, and mountable on standard rung-type ladders.

The concept of employing an auxiliary platform attachable to the rungs of a conventional ladder has been addressed by previous inventors. Common to these designs is the idea that the action of the ladder rung on a small area of one's feet can result in considerable discomfort during an extended work session; therefore, a platform is provided which is of a sufficiently large surface area that permits a substantial portion of one's feet to rest upon the surface, thereby affording essentially the same comfort as would be had by standing upon the ground. U.S. Pat. No. 2,665,952 to Edwards is typical of these, in which a platform is designed to attach to the rungs of a conventional ladder. In this patent, there is the added provision for adjustability in the angle of the platform to accommodate varying ladder angles, as well as the capacity to removably attach the platform to rungs along substantially the length of the ladder. However, there remains the need to provide a practical ladder platform which combines the features of foldability, adjustability, and lockability with an easy to use, lightweight and portable design.

It is, therefore, an object of the invention to provide a ladder platform which incorporates a leveling mechanism for the platform that compensates for varying ladder angles.

It is a further object of the invention to provide for hooks and a support bracket which will fit ladders with rungs of various shapes and sizes and will clear rungs of the lower section of an extension ladder when used on the upper section.

It is still a further object of the invention to provide a ladder platform which folds up and down, with spring biasing, permitting the platform to be out of the way of the user and affording use of every rung.

It is yet a further object of the invention to provide a ladder platform which is easily portable and can be carried with just one hand.

It is still a further object of the invention to provide a ladder platform which automatically locks onto the upper supporting ladder rung when the platform is in the folded down position, preventing accidental dislodgement during use.

These, and additional objects, advantages, features, and benefits of the invention will become apparent from the following specification.

SUMMARY OF THE INVENTION

In the present invention, a ladder platform for conventional rung-type ladders is provided having the features of adjustability, portability, lockability, and foldability.

The invention generally comprises a platform having an area sufficient to evenly distribute body weight on a substantial area of foot surface. A hinged support bracket is connected to each side of the platform nearest the ladder, each of which terminating in rung hooks. A side bracket is pivotably attached to each of the support brackets just below the hook. An extension in the side bracket provides a means to lock the rung hooks onto the rung. The side bracket terminates in the other end with an elongated slot which accommodates a shaft connected to the platform. Angle adjusters having a plurality of grooves, located on the ends of said shaft, at each side of the platform, and having a progressive variablility in the distance between the trough of the grooves and the shaft, act in cooperation with a wedge shaped stop on each end of the side brackets to provide horizontal adjustability of the platform for various ladder angles.

In operation, the user would carry the ladder platform up the ladder with one hand, the other being free to assist in climbing. It is then hooked over the desired rung. The user then proceeds further up the ladder, and while standing on the rung from which the ladder platform is hanging, reaches down with the tip of his shoe and pushes the platform down to the horizontal position, into which it is automatically locked. Adjustability of the horizontal leveling of the platform is achieved by elevating slightly the platform and rotating either of the mutually connected grooved angle adjusters until a position having the appropriate groove is found that, in conjunction with interfacing wedge shaped members, compensates for the ladder angle.

DETAILED DESCRIPTION OF THE PREFERRED EMBODIMENT

Figure 1:
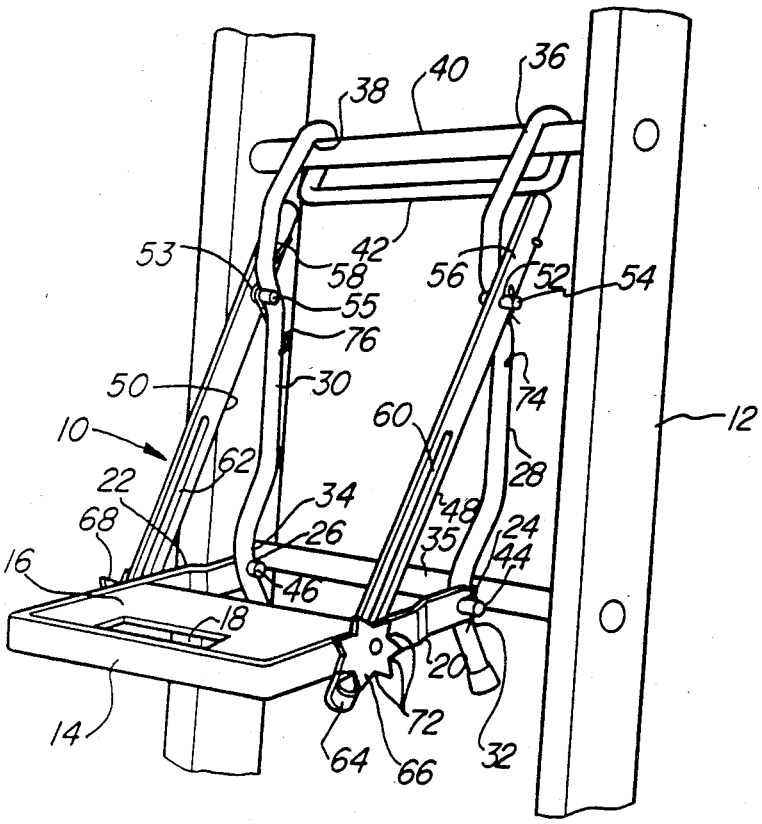
FIG. 1 is a perspective view showing generally the invention in use on a conventional rung-type ladder in the folded down position.
Figure 4:
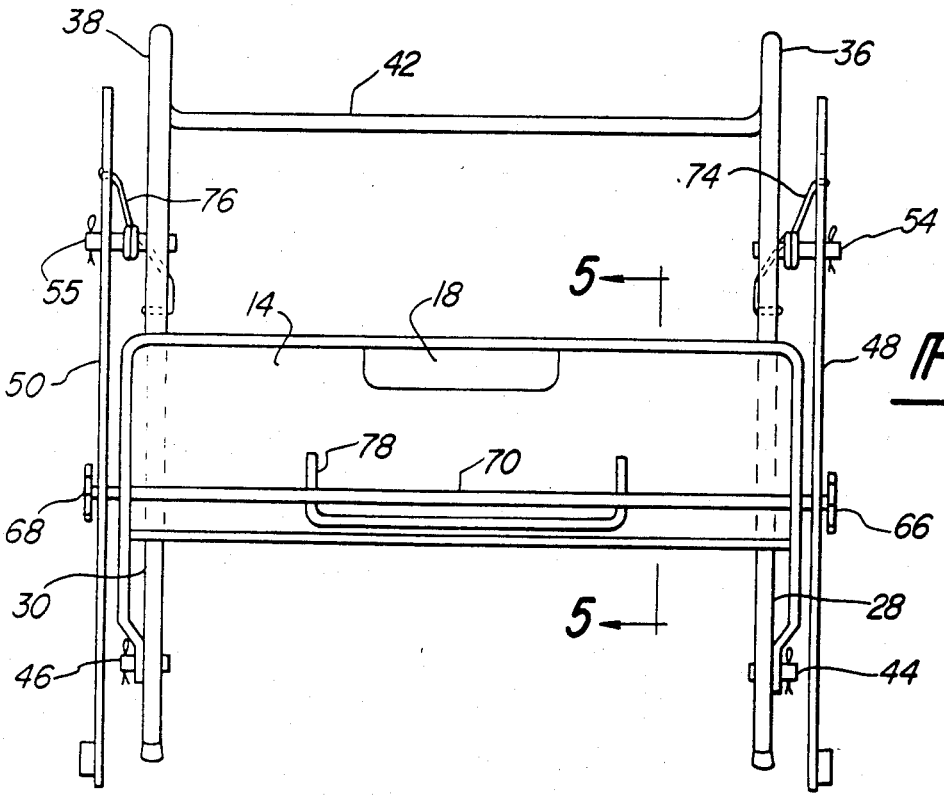
FIG. 4 is a plan view of the invention shown in the folded up position.

Referring now to the figures, FIG. 1 shows the invention 10 in use removably attached to a conventional rung-type ladder 12. A platform 14 is provided having a flat surface 16 of substantially rectangular shape and sufficient surface area to comfortably accommodate the feet of a user. The side of the platform away from the ladder is provided with a handle 18 in the form of a rectangular cut-out and the side towards the ladder is provided with a set of platform braces 20 and 22 emanating from each side of the platform, each having an aperture at their ends 24 and 26. In the preferred embodiment, the platform braces are formed of a single metal strap which is rectangularly shaped to the dimension of the platform and on to which it is attached, as can be seen in FIG. 4. A set of support braces 28 and 30 are provided having a curved section 32 and 34 near their lower end adapted for mating with a ladder rung 35 at the vertex of the radius of curvature. Between the curved section 24 and 26 and the pins 54 and 55, the support braces are formed to indent towards the ladder. This is to accommodate nesting of the platform when it is in the folded up position, getting it more completely out of the way of the user. At their upper end they are curved into the form of an upside down "U" 36 and 38 forming hooks adapted for placement over a ladder rung 40. The "U" shaped members 36 and 38 are curved into a hook structure which fits loosely but closely the widest of rungs utilized on standard rung type ladders; and because of this, the invention can be used with extension ladders without interference between the rungs of the upper and lower sections. Each of the support braces are fixedly connected to each other by means of a cross brace 42. In the preferred embodiment, the cross brace and the support braces are a single unit. At the vertex of the curved sections of the support braces, pins 44 and 46 are welded thereto having provision for cotter pins at their ends. Pins 44 and 46 are inserted through the platform brace apertures 24 and 26, respectively, and cotter pins are then inserted, thereby providing the platform with a pivotable connection to the ladder rung attachment structure. In order that the platform be rigidly affixed in a horizontal orientation, a set of side braces 48 and 50 are provided to guy the platform. The side braces are provided with apertures 52 and 53 through which are inserted pins 54 and 55 that are welded to the support braces 28 and 30, respectively, having provision for cotter pins at their ends. The location of the apertures 52 and 53 is a substantial distance from the ends of the side braces 48 and 50 in order that the side braces may extend upwardly 56 and 58 sufficiently so as to achieve accidental dislodgement of the rung from the "U" shaped section 36 and 38 of the support braces when the invention is in the folded down position. The lower end of the side braces have elongated slots 60 and 62 which begin substantially at the mid point of their length and continue until nearly their ends. At their ends, a wedge shaped member 64 on brace 48 and a wedge shaped member 65 on brace 50, not shown, is welded thereon with the point directed towards the elongated slot. The horizontal attitude of the platform is fine tuned to accommodate varying ladder angles by the use of angle adjusters 66 and 68 located on each side of the platform. The angle adjusters have a plurality of grooves about a radius of curvature defined by their attachment point, shaft 70, which also functions to fixedly connect them together, shown particularly in FIG. 4. The grooves 72 in the members 66 and 68 are located progressively greater distances from the shaft 70 about the radius of curvature. Thus, when the wedge 64 on side brace 48 and wedge 65, not shown, on side brace 50, engages the angle adjusters 66 and 68, a greater or lesser distance above or below the shaft 70 is provided, effecting to raise or lower that end of the platform furthest from the ladder; the net effect being to pivot the platform about pins 44 and 46 and thereby compensating for various ladder angles. In the preferred embodiment, seven adjusting grooves are provided. On each support brace 28 and 30 a biasing side braces 48 and 50 to cause the platform to remain in a folded up position when the platform is fully upwardly pivoted about the pins 44 and 46 towards rung 40. Also, the springs function to retain the platform in the folded down position, as will be explained in the discussion of FIG. 4. While the right side is depicted, the left side of the invention is a mirror image and functions similarly.

FIGS. 2–5 more particularly depict the exact interrelation of the component parts as just described.

Figure 2:
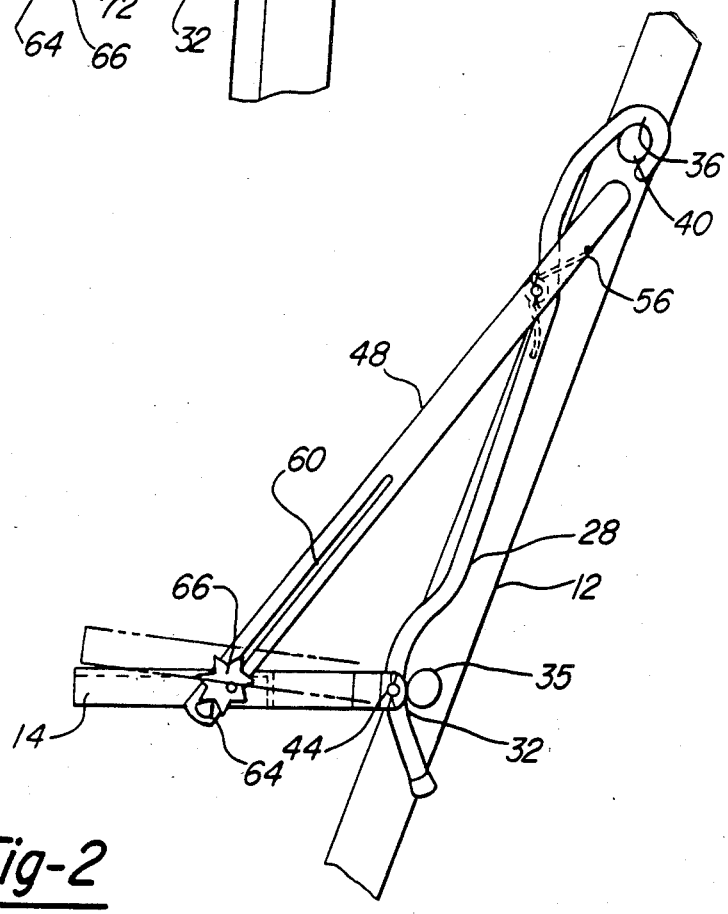
FIG. 2 is a side view of the invention showing the platform leveling means.

FIG. 2 shows the invention in the folded down position, ready for use. Illustrating the above discussion, is the way in which the "U" shaped member 36 fits over the ladder rung 40, the way in which the extension 56 of the support brace 48 acts to retain the "U" shaped member on the rung, the way in which the support bracket 28, having a curved section 32, rests at its vertex against the ladder rung 35, and finally the way in which the angle adjuster 66 cooperates with the wedge 64 in order to achieve variation in the angle of the platform 14 about the pivot located at pin 44.

Figure 3:
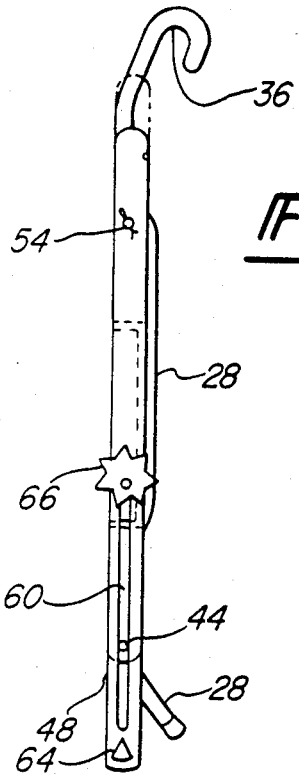
FIG. 3 is a side view of the invention showing it in the folded up position, seen along lines 5—5 in FIG. 4.

FIG. 3 shows the invention in the folded up position. The side brace 48 with its extension 56 has rotated about the pivot located at pin 54 away from the location of the "U" shaped member 36 in the support brace 28. Because of this pivoting feature, the platform is automatically locked onto the rung of the ladder at the "U" shaped member as long as the invention is in the folded down position; while the "U" shaped member is automatically free to be either removed or placed on a rung whenever the invention is in the folded up position. From the Figure it will be seen that as the platform is folded up, the angle adjusters 66 and 68 must move in a direction towards pins 54 and 55, since pivoting is occurring about pins 44 and 46. This is accommodated by the elongated slots 60 and 62 in the side braces 48 and 50, respectively.

Figure 5:
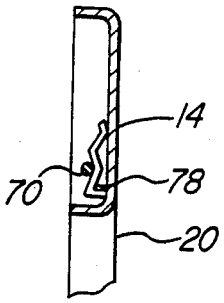
FIG. 5 is a detail side view of the spring biased means to retain a user selected position of the angle adjusters.

FIG. 4 shows the invention in the folded up position as it would appear to a user as he climbs a ladder with the invention attached. Notice that the biasing springs 74 and 76 attach, respectively, to the right and left support and side braces. They are elastically under tension when the platform is in the folded up position, as well as, to a greater extent, elastically tensioned when the platform is in the folded down position, and maximally elastically tensioned when the platform is in a position substantially midway between the folded up and folded down position, by pivotal action of the side braces 48 and 50 in cooperation with pivot pins 44 and 46; the angle of pivoting of the platform where the biasing springs are under maximum elastic tension defining whether the platform is more in the folded up or the folded down position. Thus, biasing springs 74 and 76 tend to return the platform to either the folded up or folded down position depending on whether the platform is closer to the folded up or folded down position in relation to the said location of maximum elastic tension of the biasing springs. Notice also the friction spring 78 which acts on the shaft 70 which interconnects the angle adjusters 66 and 68. It is attached to the underside of the platform and supplies frictional interaction, based upon a substantial frictional coefficient between the surfaces of the shaft and the spring, thereby serving as a means of retention of a user selected orientation between the angle adjusters and the wedges. The exact nature of the interrelation between the shaft and the friction spring is shown in FIG. 5, where the elastic response of the spring is in a direction towards the shaft.

In operation, the user carries the invention utilizing handle 18 in one hand, using the other to climb the ladder. Upon reaching the desired height, he places the "U" shaped members 36 and 38 over the rung 40 located just above the selected working height. Because of the length of the platform brackets 20 and 22, the user can continue up the ladder using each rung while the invention is in the folded up position. Upon standing on a higher rung than rung 40, the user utilizes the tip of his shoe to rotate the platform into the down position, its weight thereafter continuing the pivot action about pins 44 and 46. The user may then step down upon the platform. In the event that the ladder angle is such that the platform is not horizontal, an adjustment can be made. By lifting the platform 14 slightly, and rotating the angle adjusters 66 and 68, a groove location can be found which, when cooperatively engaging the wedges 64 and 65, will properly elevate the handle side of the platform relative to pins 44 and 46, rendering the platform horizontal. In the platform down position, extensions 56 and 58 in side braces 48 and 50 will prevent the invention from being dislodged from rung 40. To remove the invention from the ladder, the user simply stands on a rung comfortably below rung 35 and rotates the platform to the fully up position. Simultaneously, the side brace extensions 56 and 58 will rotate away from the "U" shaped members 36 and 38, permitting them to be removed from rung 40 by a simple lifting action.

In the preferred embodiment, the brace and platform members are constructed of steel components. Aluminum can be used if sufficient guage thickness is employed, designed to withstand the forces generated by a heavy set individual upon the platform, with a conventional safety factor built-in. High strength plastic parts may also be used, which would have the added benefit of excellent weather durability.

In generic use of the leveling mechanism, the platform is an example of a member having a first and second end, where one end attaches to a pivot and the other rests on the wedges via the angle adjusters, and the ladder in combination with the support, platform, and side braces serves as an example of a reference object on which the said member is pivotally attached at one end and rests at the other end on the wedges via the angle adjusters. In this use, one or more pivot locations, and one or more angle adjuster and wedge combinations can be operably employed.

To those skilled in the art to which this invention apertains, the above described preferred embodiment may be subject to change or modification. Such changes or modifications can be carried out without departing from the scope of the invention, which is intended to be limited only by the scope of the appended claims.

I claim:

1. Attachment for a ladder, comprising:

a platform;

foldable attachment means to attach said platform to said ladder, removably when said platform is in a folded up position and lockably when said platform is in a folded down position; and leveling means cooperatively connected to said platform and said foldable attachment means to level said platform responsively to a plurality of angles of use of said ladder.

2. The invention of claim 1, wherein said attachment means further includes a biasing means to bias said platform in said folded up position or said folded down position responsively to the position of said platform.

3. The invention of claim 2, wherein said leveling means further comprises:

a shaft attached to said platform and free to rotatably move about its axis;

an angle adjuster fixedly attached to each end of said shaft having a plurality of grooves of progressively greater distance from said shaft about a radius of curvature defined by said axis of said shaft;

a wedge shaped member fixedly attached to said attachment means, one on each side of said platform, adapted to cooperatively engage said grooves on said angle adjusters; and a spring fixedly attached to said platform which biases against said shaft, providing frictional action thereupon.

4. The invention of claim 3, wherein said foldable attachment means further comprises:

a platform bracket fixedly attached to each side of said platform;

a support bracket pivotably attached to each said platform bracket each having a curved section for resting against a rung of said ladder and terminating in a hook of "U" shape for placing over a second, next higher rung on said ladder;

a side bracket pivotably attached to each said support bracket, each having an extension which moves just under said second rung on said ladder when said platform is in said folded down position and moves away from said second rung when said platform is in said folded up position, having an elongated slot along a substantial portion of its lower length, and having said wedge shaped member attached to the lower end thereof with its point directed towards said elongated slot; and a shaft, passing through said elongated slot in each said side bracket, having said angle adjusters attached to each end thereof.

5. The invention of claim 4, wherein said biasing means to bias said platform in said folded up position or said folded down position responsively to the position of said platform includes a spring engaging said support bracket and said side bracket, on each side of said platform, located substantially at the point of said pivotable attachment which biases said platform toward said folded up position when said platform is more in a folded up position than a folded down position and biases said platform toward said folded down position when said platform is more in a folded down position than a folded up position.

6. Attachment for a ladder, comprising:

a platform;

a platform bracket fixedly attached to each side of said platform;

a support bracket pivotably attached to each said platform bracket, each having a curved section adapted for resting against a rung of said ladder and terminating in a hook of "U" shape for placing over a second, next higher rung on said ladder;

a side bracket pivotably attached to each said support bracket, each having an extension which moves just under said second rung on said ladder when said platform is in a folded down position and moves away from said second rung when said platform is in a folded up position, having an elongated slot along a substantial portion of its lower length, and having a wedge shaped member attached to the lower end thereof with its point directed towards said elongated slot;

a biasing spring engaging said support bracket and said side bracket, on each side of said platform, located substantially at the point of said pivotable attachment which biases said platform toward a folded up position when said platform is more in a folded up position than in a folded down position and biases said platform toward a folded down position when said platform is more in a folded down position than a folded up position;

a shaft attached to said platform and free to rotatably move about its axis;

an angle adjuster fixedly attached to each end of said shaft having a plurality of grooves of progressively greater distance from said shaft about a radius of curvature defined by said axis of said shaft adapted to cooperatively engage said wedge shaped member on each said side bracket; and a spring fixedly attached to said platform which biases against said shaft, providing frictional action thereupon.

7. A leveling mechanism, comprising:

a reference object;

a member having a first and a second end;

a pivot connecting said reference object to said member located at said first end of said member;

at least one angle adjuster rotatably attached to said second end of said member, having a plurality of grooves of progressively greater distance from an axis defined by said rotatable attachment of said angle adjuster; and at least one wedge shaped object fixedly attached to said reference object, positioned at said second end of said member, adapted to coperatively engage, with its pointed end, an individual groove of said plurality of grooves on said angle adjuster, which effect being to raise or lower said second end of said member relative to said first end of said member and said reference object.

* * * * *